US007040231B2

(12) United States Patent
Schaede

(10) Patent No.: US 7,040,231 B2
(45) Date of Patent: May 9, 2006

(54) METHOD FOR REGULATION OF A WEB ELONGATION IN A ROTARY PRINT MACHINE

(75) Inventor: Johannes Georg Schaede, Würzburg (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 21 days.

(21) Appl. No.: 10/296,247

(22) PCT Filed: Jul. 19, 2001

(86) PCT No.: PCT/DE01/02718

§ 371 (c)(1),
(2), (4) Date: Dec. 9, 2002

(87) PCT Pub. No.: WO02/07975

PCT Pub. Date: Jan. 31, 2002

(65) Prior Publication Data

US 2003/0164102 A1 Sep. 4, 2003

(30) Foreign Application Priority Data

Jul. 22, 2000 (DE) ..... 100 35 788

(51) Int. Cl.
*B65H 23/18* (2006.01)

(52) U.S. Cl. ..... 101/484; 101/181; 101/481; 101/DIG. 42; 226/28; 700/125

(58) Field of Classification Search ..... 101/181, 101/481, 484, DIG. 42; 226/27, 28, 45; 700/124, 125

See application file for complete search history.

(56) References Cited

U.S. PATENT DOCUMENTS

| | | | | |
|---|---|---|---|---|
| 2,348,862 | A * | 5/1944 | Sorkin | 226/28 |
| 3,025,791 | A | 3/1962 | Auerbacher | |
| 3,326,436 | A * | 6/1967 | Huck | 226/25 |
| 3,561,654 | A * | 2/1971 | Greiner | 226/25 |
| 3,806,012 | A * | 4/1974 | Roch | 226/2 |
| 3,841,216 | A * | 10/1974 | Huffman | 101/181 |
| 4,004,510 | A * | 1/1977 | Roch | 101/228 |
| 4,214,524 | A * | 7/1980 | Corse | 101/181 |
| 5,740,054 | A * | 4/1998 | Durr et al. | 700/122 |
| 5,937,756 | A * | 8/1999 | Kishine et al. | 101/228 |
| 6,092,466 | A | 7/2000 | Koch et al. | |
| 6,106,177 | A * | 8/2000 | Siegl et al. | 400/618 |
| 2001/0011508 | A1 * | 8/2001 | Theuner | 101/228 |

FOREIGN PATENT DOCUMENTS

| | | |
|---|---|---|
| DE | 92 18 978 U1 | 8/1996 |
| EP | 0 950 519 A1 | 10/1999 |
| EP | 0 951 993 A1 | 10/1999 |

* cited by examiner

*Primary Examiner*—Andrew H. Hirshfeld
*Assistant Examiner*—Jill E. Culler
(74) *Attorney, Agent, or Firm*—Jones Tullar & Cooper PC

(57) ABSTRACT

Tension of a web in a rotary printing press is regulated. The web passes through at least two printing groups in the printing press. A change in the extension of the web during the print run is determined based on a phase shift between a first phase position of a printing group and a second phase positioned measured after a last printing group. The change in phase position is compensated for by a change in the web tension prior to the first printing group.

22 Claims, 1 Drawing Sheet

METHOD FOR REGULATION OF A WEB ELONGATION IN A ROTARY PRINT MACHINE

FIELD OF THE INVENTION

The present invention is directed to a method for regulating a web elongation in a rotary printing press. The web passes through at least one print unit in the printing press.

BACKGROUND OF THE INVENTION

A register-maintaining drive mechanism for a rotary printing press is disclosed in EP 0 951 993 A1. A longitudinal elongation of the web to be imprinted is determined from web tension and from operating values of the drive mechanisms. Elongation is compensated for by adjusting the circumferential register at the cylinders, or the register rollers. A change in transverse elongation detected by use of a sensor for detecting the web width is fed back via a correcting value to the reference variable of the traction roller, which is regulated to web tension constancy.

A method for regulating the drive mechanisms of a printing press, directed toward producing a constant web elongation, is disclosed in U.S. Pat. No. 3,025,791. Here, the measurement of the web elongation takes place close to the first print unit by comparing the angular position of the print unit, and thereafter the position of a marker on the material to be imprinted. A change in the relative position causes a change in the tension of the web of material to be imprinted to be effected in the draw-in unit.

DE 92 16 978 U1 discloses a first regulating circuit, where a tension between a print unit and a traction roller is regulated by a first circuit to be constant. In a second regulating circuit, the angular position of the cutting cylinder is regulated via the drive mechanism of the cutting cylinder on the basis of a rotary position of the print unit and the cutting cylinder, as well as on the basis of an optical signal which processes the position of a marker.

SUMMARY OF THE INVENTION

The object of the present invention is directed to providing methods for regulating a web elongation in a rotary printing press.

In accordance with the present invention, this object is attained by passing a web through at least one print unit. A first phase position of the at least one print unit is measured. A second phase position is measured downstream of the at least one print unit. These phase position measurements are used to control the elongation in the web.

The advantages which can be achieved by the present invention reside, in particular, in that fluctuations or changes in the elongation of a web during a production run, i.e. of a web during continuous printing, can be measured in a simple way, and that this measurement is used for regulating the web draw-in unit which is located upstream of the first print unit.

Measurement downstream of the last print unit, in particular, provides the most information regarding the operational state of the web prior to running the printing web into a subsequently provided superstructure of the printing press, in particular into a hopper inlet.

The tension/elongation behavior of the web, when the web passes through the imprinting position, changes with the addition of water and/or ink to the web and causes, for example, an increase in the web elongation after the last print unit. So that during multiple web operations, a problem-free insertion of the multiple webs into the hopper is assured, the suitable web tension level of each of the webs with respect to each other for achieving the necessary gradation in the web tension after water and ink have been added is matched, if possible, only by adjusting the web draw-in unit.

The paper web expands under the effects of the damping agent and/or the ink applied to it, both in the longitudinal and in the transverse directions in relation to the web conveying direction. This expansion has the effect of elongating the web, in particular in connection with multi-color printing, with a resulting creation of empty spaces between neighboring imprinting locations. As long as this effect remains almost chronologically constant at each imprinting location, this web elongation can be compensated for, at least partially, for example by changing the register at the cylinders, by changing the position of register rollers, or by changing other devices.

However, the elongation behavior of the paper web is subject to many influences such as, but not limited to, the tension/elongation characteristics of the respective paper, and thus to the prevailing tension, the instantaneous moisture, the sensitivity of the web to moisture, the penetrating behavior of the moisture into the web, the position of the roll as it is produced in the reel spool which, for example, has the effect of changing winding tightness, or a positionally-dependent fluctuation of the module of elasticity of the web.

Therefore, the web elongation, both the longitudinal and the transverse web elongation, is not uniform because of the varying paper properties of the unwinding paper web itself, and because of changing, and fluctuating operating parameters of the printing press. A fluctuating web tension, changing printing speeds, fluctuations in dampening, or a change of the web roll also can affect the elongation of the paper web, so that the web elongation is not constant or uniform over time.

With the aid of the method of the present invention, it is possible, in an advantageous manner, to compensate for changes or fluctuations in the web elongation, and in particular to compensate for changes in the longitudinal elongation in the web conveying direction.

The determination of the change in web elongation at the end of a printing tower or following the last print unit in the conveying direction is also beneficial. It provides good information regarding the entire web change for the subsequent processing steps, and allows the initiation of countermeasures, if desired in the interest of maintaining a constant tension or, as preferred here, a constant elongation of the web, for the subsequent travel of the web or the processing steps. In this sense, it is also advantageous that the regulation takes place not in the area of measurement, but at the start of the web, by which regulation, a level of the web tension, or a resulting initial web elongation, is fixed and is regulated thereafter without causing substantial changes of the web tension and/or elongation in the superstructure, in particular upstream of the hopper draw-in roller.

By detecting the web elongation change downstream of the last print unit, and by effecting a corresponding regulation of the web inlet elongation, it is possible to assure that the number and the exact phases of the print images between the last print unit, or between the last imprinting location, and a folding apparatus, for example, is constant. This is something which is cumbersome or difficult to do by merely adjusting individual registers. Therefore, the method in accordance with the present invention makes the constant readjustment of the cutting register of a web by the use of all of the drive mechanisms of the print units, or by the use of register rollers, during the production run, at least partially unnecessary.

BRIEF DESCRIPTION OF THE DRAWINGS

A preferred embodiment of the present invention is represented in the drawings and will be described in greater detail in what follows.

Shown are in.

DESCRIPTION OF THE PREFERRED EMBODIMENT

Figure 1:
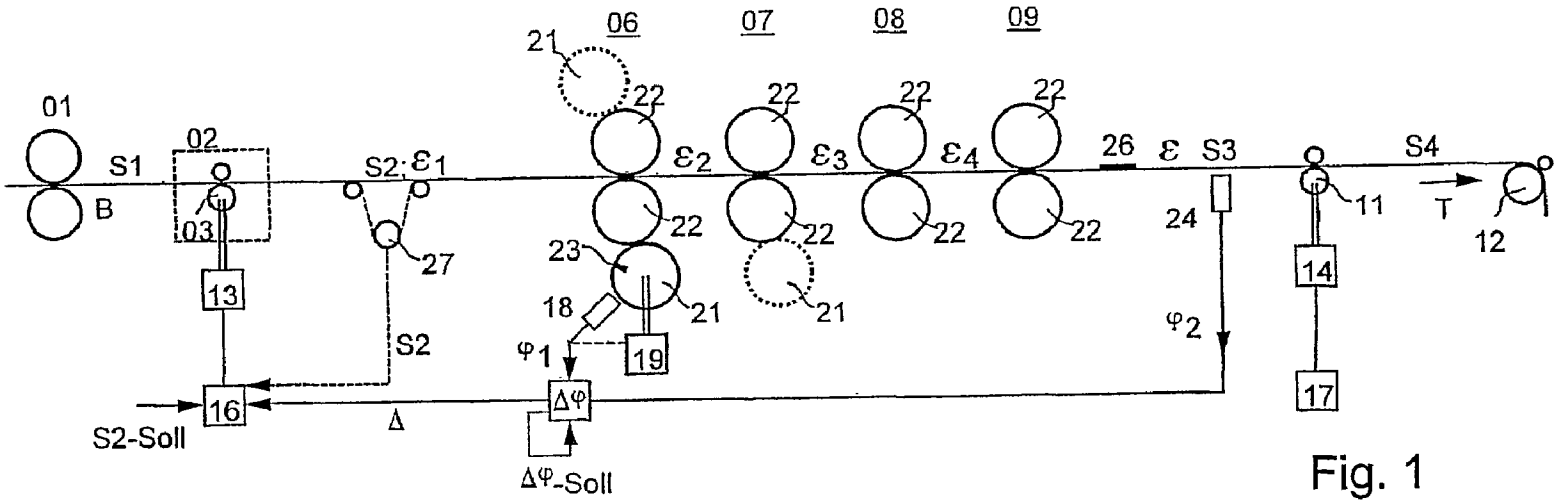
FIG. 1, a schematic representation of the guidance of a web from the draw-in unit over four print units and past a second traction roller up to the hopper inlet roller, and in FIG. 2, a schematic representation of the web tension level during the production run.

The course of travel of a web B, for example a web B to be imprinted, or a paper web B, through a printing press, and in particular through a web-fed rotary printing press, is represented in FIG. 1. The web B runs in the web conveying direction T from the roll changer 01 through a draw-in unit 02 with a first traction roller 03 through the, for example, four print units 06 to 09 and to a second traction roller 11. Turning bars, cutting blades, further traction or guide rollers, which are not specifically represented, and finally a hopper inlet roller 12 follow downstream of the second traction roller 11. In an advantageous embodiment, the first and second traction rollers 03, 11, respectively are each equipped with their own drive mechanisms 13, 14, and each is also provided with a drive regulating device 16, 17. In a preferred embodiment, tensions S1, S2, S3 and S4 of the web B are measured upstream of the draw-in unit 02, between the draw-in unit 02 and the first print unit 06, between the last print unit 09 and the second traction roller 11, and on the free path between the second traction roller 11 and the hopper inlet roller 12, respectively, all as seen in FIG. 1. Each tension measurement can take place, for example, via measuring rollers, or via a measurement of the power consumption of the drive motors of the traction members.

Figure 2:
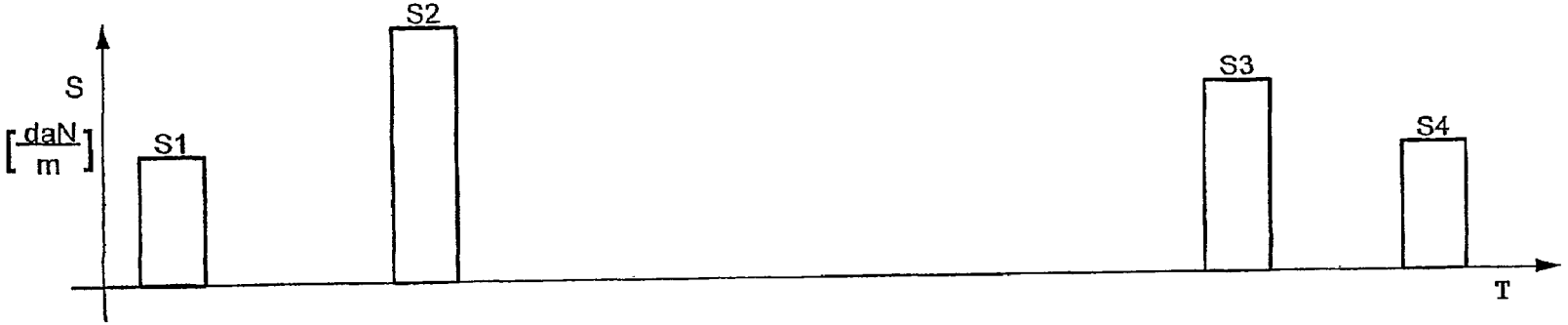

The absolute and the relative tensions S4 of the individual webs B, with respect to each other at the hopper inlet roller 12, are the starting point for setting the tension in a web B, in particular when, during multi-web operations, several webs B are combined at the hopper inlet by use of the hopper inlet roller 12. Therefore, the setting of the tensions in the web B is made starting with the desired level of the tension S4 of each web B at the hopper inlet roller 12. The level of the entire tension in the web B is preferably set by an adjustment made at the draw-in unit 02. In a customary way, a change of the tension in the web B also occurs, in an advantageous manner during the production run, by a change of the tension S2 at the draw-in unit 02. As schematically represented in FIG. 2, for example, the basic setting of the web tension during the production run is set, via use of the traction roller 03, which is regulated in accordance with web tension, in accordance with web speed or position, by the also regulated hopper draw-in roller 12 and/or by other compensating rollers, not represented.

Because of the tension imparted to the web and, in particular, during the production run, because of the moisture applied to the web, the web B is subjected to longitudinal elongations, during its travel from the draw-in unit 02 to the second traction roller 11 downstream of the last print unit 09, with there being an initial elongation $\epsilon$1 of the web B and with a subsequent elongation $\epsilon$ of the web B downstream of the last print unit 09. With the web B passing through the four print units 06 to 09, $\epsilon$2 represents an elongation between the first print unit 06 and the second print unit 07, $\epsilon$3 represents an elongation between the second print unit 07 and the third print unit 08, and $\epsilon$4 represents an elongation between the third print unit 08 and fourth print unit 09.

This condition of the web B, wherein, as a rules the web tension is regulated during the production run, i.e. at the printing speed and by adding water and/or ink, and where the first traction roller 03 trails and the second traction roller 11 leads with respect to the speed of the press, already takes into consideration an elongation of the web B which is a result of the printing process and the effects of the moisture imparted to the web.

The determination of the speed of the press and/or the phase position of the press at the print units 06, 07, 08, 09 can take place in different ways. In case each one of the print units 06, 07, 08, 09 is individually driven, it is possible to use the output data, the angle of rotation positions, or other characteristic values of all, or of individual ones of the print units 06, 07, 08, 09.

In the preferred embodiment, a phase position $\phi$1 of the first print unit 06 is measured by use of a sensor 18. This phase position $\phi$1 can be picked up, for example at a motor shaft of a drive mechanism 19 for the cylinder 21; in particular a drive mechanism 19 of a forme cylinder 21 of the print unit 06, for example by the use of an encoder which is represented in dashed lines in FIG. 1. If the forme cylinder 21 of the first print unit 06 is coupled with a cooperating cylinder 22, and in particular with a transfer cylinder 22, the phase position $\phi$1 of the transfer cylinder 22 can also be determined. As represented in FIG. 1, it is also possible to use the arrangement of a marker 23 as reference spot 23 on the forme cylinder 21, or on the transfer cylinder 22, together with a first sensor 18 for determining a phase position $\phi$1. This can be done by use of a scanner or a photoelectric cell, for example. Also, a marker 23 applied by the print unit 06 itself to the web, a portion of the print image itself that is applied to the web, a perforation of the web, or other markings on the web B can also be used as a marker 23 for determining the first phase position $\phi$1.

A further or subsequent sensor 24 is arranged downstream of the last print unit in the conveying direction T, in this case, the subsequent sensor 24 is arranged downstream of the fourth print unit 09. A second phase position $\phi$2, or a position $\phi$2 of a second marker 26, or at least a portion of a print image of an imprinted web B, is measured by this subsequent sensor 24. The second marker 26 can also be a perforation in the web B, or an equivalently functioning marker on the web B. The phase position $\phi$2 of the second marker 26 is here understood to be the chronological sequence of the passage of the mark 26 past the detector 24. If the determination of the phase position $\phi$1 is performed by use of a marker 23 arranged on the web B, it is possible to employ the marker 23 as the marker 26, which markers are identical in this case, for the determination of the phase position $\phi$2.

During the running of the web B, first the phase position $\phi$1 of the print unit 06 is determined by measuring the passage of the marker 23. After passing through the print units 06 to 09, the second phase position $\phi$2 of the marker 26 printed on the web, or on the portion of the print image, is determined downstream of the last print unit 09. Assuming a fixed position of the measurement locations with respect to each other, a fixed phase shift $\Delta\phi$ can now be determined, with a chronologically constant elongation $\epsilon$ of the web B, over all partial sections. The method for regulating a web tension in a rotary printing press, in accordance with the present invention, now comes into play since, for the previously discussed reasons, the elongation $\epsilon$ of the web B is not chronologically constant during production.

The value of the phase shift $\Delta\phi$, determined, for example, at the start of the production run and after reaching the desired tensions S1 to S4, is maintained as the reference variable $\Delta\phi$-Soll in a memory unit, for example. The reference variable $\Delta\phi$-Soll can be different from one production to another production, since it is a function of the register state of the print units 06 to 09. However, it should first be fixed during steady state and interference-free operation. Setting the register state, as well as the tensions S1 to S4 has already, as has been mentioned above, taken place in their base position, prior to starting production, and is tailored to the paper properties, the web travel and to other, previously mentioned parameters.

A deviation $\Delta$ of the actual value $\Delta\phi$ from the reference variable $\Delta\phi$-Soll now provides information regarding changes $\Delta\epsilon$ or fluctuations in the elongation $\epsilon$ occurring in the web in the course of the production run.

In order to counteract changes $\Delta\epsilon$ or fluctuations in the web elongation $\epsilon$, and in particular changes $\Delta\epsilon$ in the web elongation occuring in the printing press section length between the last print unit and prior to further web processing by folding, occurring during the production run for the above mentioned reasons, the phase positions $\phi$1 and $\phi$2, and therefore the phase shift $\Delta\phi$, are determined and are compared with the reference variable $\Delta\phi$-Soll. If, in the course of the production run, the deviation $\Delta$ in the difference $\Delta\phi$ from the reference variable $\Delta\phi$-Soll occurs for one of the above mentioned reasons, this is an indication for a change $\Delta\epsilon$ of the elongation $\epsilon$ of the web B.

If the phase shift $\Delta\phi$ has been defined as the difference $\Delta\phi=\phi 2-\phi 1$, for example, an increase in the web elongation $\epsilon$ by $\Delta\epsilon$ causes a deviation $\Delta$ of the phase shift $\Delta\phi$ from the reference variable $\Delta\phi$-Soll, for example.

This deviation $\Delta$, and therefore also the change $\Delta\epsilon$ in the elongation $\epsilon$, is now compensated for with the draw-in unit 02, which is situated upstream of the first print unit 06. This compensation is accomplished by effecting a change of the initial elongation $\epsilon$1, until the reference variable $\Delta\phi$-Soll of the phase shift $\Delta\phi$ has been restored. So that an oscillation, or an erratic web running of the web B is reduced or avoided, the regulation can also allow for certain tolerances in the deviation of the phase shift $\Delta\phi$ from the reference variable $\Delta\phi$-Soll before the counter-measure of a change in the initial elongation $\epsilon$1 is taken.

The deviation $\Delta$ from the reference variable $\Delta\phi$-Soll can, for example, be superimposed on the reference variable transducer of the drive regulating device 16, for example as an interference variable $\Delta$. The drive regulating device 16 of the traction roller 03 can be regulated with respect to torque, for example, wherein a feedback of the tension S2 takes place. A path of the web B over an appropriate measuring roller 27, for measuring the tension S2 of the web B, is represented in dashed lines in FIG. 1. An interference variable $\Delta$, corresponding to the deviation $\Delta$ from the reference variable $\Delta\phi$-Soll, is superimposed on the reference value transducer of the drive regulating device 16, for example as a correcting value $\Delta$S2. Such a correcting value $\Delta$S2 can be taken from a stored curve of the dependency of $\Delta$S2 over $\Delta$, for example, or can also be performed iteratively by raising or lowering the tension S2 until the phase shift $\Delta\phi$ again corresponds to the reference variable $\Delta\phi$-Soll.

If it is intended to avoid abrupt changes in the force on the web B, it is also possible to fall back to a drive control device with DROOP behavior for the traction roller 03. A load-dependent change of the reference variable of a circumferential or of an angular velocity or of the number of revolutions is called DROOP behavior, which behavior takes into consideration a change in the tension of the web B, for example S4, as well as a change in the angular velocity. In this case, a correcting value $\Delta$S2 is superimposed on the reference variable S2-Soll for the tension S2 which, together with the actual value of the tension S2, by use of the DROOP function, results in a corresponding trailing of the traction roller 03, and therefore a different tension S2 and a resultant different initial web elongation $\epsilon$1, which, in the end, also appears as a change of the elongation $\epsilon$.

Regardless of the type of regulation of the traction roller 03, or of the draw-in unit 02, it is essential that an interference variable $\Delta$, derived from difference between the actual phase shift $\Delta\phi$ and the reference variable $\Delta\phi$-Soll, is superimposed on the reference variable $\Delta\phi$-Soll for the drive regulating device 16, for example as the correction value $\Delta$S2 of the desired tension S2. If required, it is possible to determine the phase position $\phi$1 on one of the subsequent print units 07 to 09 instead of at the print unit 06, which is the first print unit in the conveying direction T. In this case, the phase shift $\Delta\phi$ must be determined between the respective print units 06 to 09 and the position of the marker 23 at the sensor 24. The deviation $\Delta$ of the phase shift $\Delta\phi$ from the reference variable $\Delta\phi$-Soll is again processed as the interference variable $\Delta$ for the drive mechanism of the traction roller 03.

Concurrently with the determination of the phase positions $\phi$1 and $\phi$2, and therefore of the phase shift $\Delta\phi$ from the reference variable $\Delta\phi$-Soll for establishing the interference variable $\Delta$, it is also possible to use the chronological or time dependant change of the phase shift $\Delta\phi$ or, if the interference variable $\Delta$ is determined linearly from the difference in the phase position $\phi$1 and $\phi$2, also to use the change in the difference in the chronological change of the phase positions $\Delta\phi=\phi 2-\phi 1$. In that case, $\Delta\phi\approx 0$ in interference-free operation.

The correction value $\Delta$S2, as the tension change $\Delta$S2, can also be changed in other ways at the traction roller 03 by use of the interference variable $\Delta$. The change of the tension S2, by use of the interference variable $\Delta$, also includes changes in the force effect from a compensating roller, which is not specifically represented, or from other actuating devices for the tension S2 arranged upstream of the first print unit 06.

In an advantageous manner, no direct feedback of an elongation change $\Delta\epsilon$, detected downstream of the last print unit 09, to the drive regulating device 17 of the traction roller 11 which is also arranged downstream of the last print unit 09, takes place. Instead, a change of the initial elongation $\epsilon$1 takes place by a change of the tension S2.

With a change $\Delta\epsilon$ of the elongation $\epsilon$, a deviation $\Delta$ of the relative phase position $\Delta\phi$ from the reference variable $\Delta\phi$-Soll, between a first measurement location by use of the sensor 18, of the phase position $\phi$1 of the forme cylinder 21, and the second measuring location by use of the sensor 24, the position of the mark 23 on the imprinted web B after passage through the print units 06 to 09, occurs. This deviation $\Delta$ is entered as an absolute value, or as a signed value, as the interference variable $\Delta$ for regulating the tension S2 upstream of the first print unit 06. By use of this method in accordance with the present invention, it is assured that, for subsequent work steps, such as folding or cutting, for example, there is a constant number of print images between the traction roller 11 and the following processing step, and that the frequency of the passage of the print images at the traction roller 11 is maintained almost constant.

A variation in the tension S2 of the web B upstream of the first print unit 06 is tolerated, if necessary, in favor of a constant section length, or web elongation $\epsilon$, downstream of the last print unit 09. In any case, the web tension S2 moves within a window of the permissible tension and of the resultant tension S4 in view of the gradation during multi-web operations.

While a preferred embodiment of a method for regulation of a web tension in a rotary printing press, in accordance with the present invention, has been set forth fully and completely hereinabove, it will be apparent to one of skill in the art that a number of changes in, for example the specific type of rotary printing press, the number of print units and the like could be made without departing from the true spirit and scope of the present invention which is accordingly to be limited only by the following claims.

What is claimed is:

1. A method for regulating elongation in a paper web in a rotary printing press including:

providing at least first and second printing units in the printing press;

passing a paper web through said at least first and second printing units in a direction of web travel;

providing a marker on the web at said at least first printing unit;

measuring a first phase position of said at least first printing unit using said marker;

measuring a second phase position of said marker on the web downstream, in a direction of web travel, of said at least second printing unit;

determining an actual value of a phase shift as a difference between said first phase position and said second phase position;

providing a reference value phase shift;

comparing said actual value phase shift with said reference value phase shift to determine a phase shift deviation value;

providing a means for regulating a tension in said web upstream of said at least first printing unit;

using said tension regulating means for regulating an initial elongation of the web prior to said first printing unit in response to said phase shift deviation value of said actual value phase shift from said reference value phase shift; and maintaining a resultant web elongation constant after a last one of said at least first and second printing units in said direction of web travel, by regulating said initial web elongation of the web prior to said first printing unit by using said tension regulating means upstream of said at least first printing unit for regulating said initial elongation of the web prior to said first printing unit.

2. The method of claim 1 further including providing a first sensor and using said first sensor for detecting said first phase position at a cylinder of said at least first printing unit, providing a second sensor and locating said second sensor downstream of said second printing unit and using said second sensor for detecting said second phase position of said marker, and providing said reference value phase shift during steady state and interference-free operation of the printing press.

3. The method of claim 2 further including providing a reference spot on said cylinder and using said reference spot for determining said first phase position.

4. The method of claim 2 wherein said cylinder is a forme cylinder.

5. The method of claim 1 further including providing print images on the web and maintaining a number of print images on the web constant between said second print unit and a subsequent web processing stage.

6. The method of claim 1 further including a web draw-in unit as said tension regulating means and using said deviation value for regulating said draw-in unit.

7. The method of claim 6 further including providing said means for adjusting a tension in the web intermediate said web draw-in unit and said first printing unit.

8. The method of claim 1 further including forming a print image on the web and using a portion of said print image as said marker.

9. The method of claim 1 further including providing a traction roller having a drive regulating device, locating said traction roller before, in said direction of web travel said first printing unit and using said traction roller as said tension regulating means for regulating said initial elongation in the web prior to said first printing unit.

10. A method for regulating elongation in a paper web in a rotary printing press including:

providing at least first and second printing units in the printing press;

passing a paper web through said first and second printing units in a direction of web travel;

measuring a first phase position of one of said at least first and second printing units and before a last one of said at least first and second printing units in said direction of web travel;

measuring a second phase position on the web downstream of said last one of said at least first and second printing units in said direction of web travel;

using said first and said second phase positions for adjusting a tension in the web before, in said direction of web travel, said first printing unit;

regulating an initial elongation in the web by adjusting said tension in the web before, in said direction of web travel, said first printing unit; and maintaining a resultant web elongation constant after said last one of said at least first and second printing units by regulating said initial web elongation of the web prior to said first printing unit by adjusting said tension in the web before said first printing unit for regulating said initial elongation of the web prior to said first printing unit.

11. The method of claim 10 further including placing a marker on the web and determining said second phase position at said marker.

12. The method of claim 11 further including forming a print image on the web and using a portion of said print image as said marker.

13. The method of claim 10 further including changing an initial tension in the web for regulating said initial elongation in the web.

14. The method of claim 10 further including determining an actual value of a phase shift using said first and second phase positions, providing a reference value phase shift, comparing said actual value phase shift to said reference value phase shift, determining a phase shift deviation value and changing said tension as a result of said phase shift deviation value.

15. The method of claim 14 further including a web draw-in unit for regulating said initial elongation in the web and using said deviation value for regulating said draw-in unit.

16. The method of claim 15 further including providing said means for adjusting a tension in the web intermediate said web draw-in unit and said first printing unit.

17. The method of claim 10 further including providing a first sensor and using said first sensor for detecting said first phase position at a cylinder of said at least first printing unit, providing a second sensor and locating said second sensor downstream of said second printing unit and using said second sensor for detecting said second phase position of said marker, and providing said reference value phase shift during steady state and interference-free operation of the printing press.

18. The method of claim 17 further including providing a reference spot on said cylinder and using said reference spot for determining said first phase position.

19. The method of claim 17 wherein said cylinder is a forme cylinder.

20. The method of claim 10 further including providing print images on the web and maintaining a number of print images on the web constant between said second print unit and a subsequent web processing stage.

21. The method of claim 10 further including determining said first phase position at said first print unit.

22. The method of claim 10 further including providing a traction roller having a drive regulating device, locating said traction roller before, in said direction of web travel said first printing unit and using said traction roller for regulating said initial elongation in the web by adjusting said tension in the web before said first printing unit.

* * * * *